US011370570B2

(12) United States Patent
Fujihara et al.

(10) Patent No.: US 11,370,570 B2
(45) Date of Patent: Jun. 28, 2022

(54) CONTINUOUS BAG-MAKING AND PACKAGING APPARATUS

(71) Applicant: ISHIDA CO., LTD., Kyoto (JP)

(72) Inventors: Hiroki Fujihara, Ritto (JP); Naoki Furuya, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 250 days.

(21) Appl. No.: 16/352,827

(22) Filed: Mar. 14, 2019

(65) Prior Publication Data

US 2019/0291908 A1 Sep. 26, 2019

(30) Foreign Application Priority Data

Mar. 20, 2018 (JP) ..... JP2018-051966

(51) Int. Cl.

| | |
|---|---|
| ***B65B 43/04*** | (2006.01) |
| ***B65B 57/02*** | (2006.01) |
| ***B65B 61/02*** | (2006.01) |
| ***B65B 9/20*** | (2012.01) |
| ***B65B 9/207*** | (2012.01) |
| ***B65B 57/18*** | (2006.01) |
| ***B65B 41/18*** | (2006.01) |
| ***B65B 57/04*** | (2006.01) |
| ***B65B 57/08*** | (2006.01) |

(52) U.S. Cl.

CPC ..... *B65B 43/04* (2013.01); *B65B 9/207* (2013.01); *B65B 9/2028* (2013.01); *B65B 41/18* (2013.01); *B65B 57/02* (2013.01); *B65B 57/04* (2013.01); *B65B 57/08* (2013.01); *B65B 57/18* (2013.01); *B65B 61/025* (2013.01)

(58) Field of Classification Search

USPC ..... 53/131.5

See application file for complete search history.

(56) References Cited

U.S. PATENT DOCUMENTS 6,088,994 A 7/2000 Nakagawa et al.
6,834,480 B1 * 12/2004 Ishino ..... B65B 9/20 53/55

(Continued)

FOREIGN PATENT DOCUMENTS

AU 2016267216 A1 11/2017
CN 1156291 A 8/1997

(Continued)

OTHER PUBLICATIONS

The Office Action from the corresponding Chinese Patent Application No. 201910192476.2 dated Sep. 30, 2020.

(Continued)

*Primary Examiner* — Chinyere J Rushing-Tucker
(74) *Attorney, Agent, or Firm* — Shinjyu Global IP

(57) ABSTRACT

A continuous bag-making and packaging apparatus is disclosed. In the apparatus, sealing is performed on a film at a predetermined position to make a bag while the film is continuously conveyed. The apparatus includes a film-conveying unit configured to change a feeding speed of the film, a printing unit configured to print on the film conveyed, a bag information acquisition unit configured to acquire information of a bag to be made, and a print timing presentation unit configured to present information pertaining to a print timing suitable for printing based on the information of the bag.

9 Claims, 7 Drawing Sheets

(56) References Cited

U.S. PATENT DOCUMENTS

| | | | | |
|---|---|---|---|---|
| 2010/0064637 | A1* | 3/2010 | Kollmuss | B65B 11/10 53/461 |
| 2011/0059833 | A1* | 3/2011 | Kiyota | B29C 66/81821 493/189 |
| 2015/0291300 | A1* | 10/2015 | Brandt Sanz | C11D 17/042 428/35.2 |

FOREIGN PATENT DOCUMENTS

| | | | |
|---|---|---|---|
| EP | 3246262 | A1 | 11/2017 |
| JP | H06-127533 | A | 5/1994 |
| JP | H08-217039 | A | 8/1996 |
| JP | 2004-358767 | A | 12/2004 |
| JP | 5908974 | B2 | 4/2016 |
| WO | 2017/094341 | A1 | 6/2017 |
| WO | 2019/035265 | A1 | 2/2019 |

OTHER PUBLICATIONS

The Office Action from the corresponding Australian Patent Application No. 2019201894 dated Nov. 13, 2019.
The Search Report from the corresponding European Patent Application No. 19162600.1 dated Aug. 6, 2019.
The Office Action from the corresponding Japanese Patent Application No. 2018-051966 dated Jan. 11, 2022.

* cited by examiner

CONTINUOUS BAG-MAKING AND PACKAGING APPARATUS

CROSS-REFERENCE TO RELATED APPLICATIONS

This application claims priority to Japanese Patent Application No. 2018-51966, filed Mar. 20, 2018. The contents of that application are incorporated by reference herein in their entirety.

TECHNICAL FIELD

The present disclosure relates to a "continuous bag-making and packaging apparatus" in which a film is shaped into a tube form by a former while being continuously conveyed, a bag formed at a lower end of the tube is filled with articles, a transverse seal is then performed simultaneously on an upper opening part of the bag and on a bottom of a successive bag continuing from the first bag, and a border between the upper and lower bags is separated.

BACKGROUND ART

Conventionally, in continuous bag-making and packaging apparatuses in which films are continuously conveyed, printing on the films has involved the use of a method such as is disclosed in, for example, Japanese Laid-open Patent Publication No. 6-127533, in which printed films are temporarily held and accumulated, whereby printing intervals will not be irregular even if the films are pulled taut, or a method such as is disclosed in Japanese Laid-open Patent Publication No. 8-217039, in which printing speed is adapted to be in synchronization with a film-conveying speed.

BRIEF SUMMARY

However, a print position on a film is determined in either of the methods described above, and an optimal print timing, which takes into account the print position as well as a feeding speed of the film suitable for printing, is therefore adjusted through repeated trial and error.

An object of the present disclosure is to provide a continuous bag-making and packaging apparatus with which an operator can easily set the optimal print timing.

A continuous bag-making and packaging apparatus according to a first aspect of the present disclosure is a continuous bag-making and packaging apparatus in which sealing is performed on a film at a predetermined position to make a bag while the film is continuously conveyed, the continuous bag-making and packaging apparatus comprising a film-conveying unit to change a feeding speed of the film, a printing unit to print on the film being conveyed, a bag information acquisition unit to acquire information of a bag to be made, and a print timing presentation unit. The print timing presentation unit presents information pertaining to a print timing suitable for printing on the basis of the bag information.

According to this continuous bag-making and packaging apparatus, the operator can set a print timing on the basis of information pertaining to the print timing; accordingly, there are fewer trial-and-error repetitions, and productivity improves.

A continuous bag-making and packaging apparatus according to a second aspect of the present disclosure is the continuous bag-making and packaging apparatus according to the first aspect, wherein the print timing presentation unit displays the print timing through a display screen that displays timings of actions of the bag-making.

According to this continuous bag-making and packaging apparatus, the operator can visually observe the print timing from the display screen, thus affording ease of use.

A continuous bag-making and packaging apparatus according to a third aspect of the present disclosure is the continuous bag-making and packaging apparatus according to the first or second aspect, wherein the print timing presentation unit displays, on an input screen in which the print timing is inputted, whether or not a value inputted through the input screen is appropriate.

According to this continuous bag-making and packaging apparatus, the operator can make corrections while visually observing appropriateness of the set print timing, thus affording ease of use.

A continuous bag-making and packaging apparatus according to a fourth aspect of the present disclosure is the continuous bag-making and packaging apparatus according to any one of the first through third aspects, wherein the print timing presentation unit calculates the feeding speed of the film at timepoints in a bag-making cycle from the bag information, further calculates an acceleration/deceleration range over which printing is possible from a following capacity of the printing unit, and assesses the appropriate print timing.

According to this continuous bag-making and packaging apparatus, the print timing is assessed on the basis of both the film-feeding speed and the following capacity of the printing unit, thus affording high reliability.

A continuous bag-making and packaging apparatus according to a fifth aspect of the present disclosure is the continuous bag-making and packaging apparatus according to any one of the first through fourth aspects, wherein the print timing presentation unit calculates the feeding speed of the film using bag-making capacity, bag length, and transverse sealing time as parameters.

According to this continuous bag-making and packaging apparatus, bag-making capacity, bag length, and transverse sealing time are necessary and sufficient parameters, and a highly accurate feeding speed can be calculated.

A continuous bag-making and packaging apparatus according to a sixth aspect of the present disclosure is the continuous bag-making and packaging apparatus according to any one of the first through fifth aspects, wherein the print timing presentation unit has a selection screen to select a printer to be used in the printing unit, and the acceleration/deceleration range over which printing is possible is determined in accordance with the printer selected in the selection screen.

According to this continuous bag-making and packaging apparatus, the operator is saved the trouble of determining the acceleration/deceleration range, thus affording ease of use.

A continuous bag-making and packaging apparatus according to a seventh aspect of the present disclosure is the continuous bag-making and packaging apparatus according to the third aspect, further comprising a register mark detection sensor to detect a register mark marked on the bag. A distance from the register mark is included as print position data in the bag information.

According to this continuous bag-making and packaging apparatus, the distance from the register mark is a factor in determining the print timing and a reference can be assigned; therefore, the print position can be set while the print position is being imaged. The "distance from the register mark" is the distance the film is conveyed after the register mark detection sensor detects the register mark. Additionally, the phrase "the print position can be set while the print position is being imaged" means that the print position can be adjusted without taking care of the print timing (while observing an image displayed on the input screen). Furthermore, to "adjust the print position" is to adjust a "vertical position" of a print location displayed on the input screen.

A continuous bag-making and packaging apparatus according to an eighth aspect of the present disclosure is the continuous bag-making and packaging apparatus according to any one of the first through seventh aspects, wherein the print timing presentation unit is a computation unit to compute the print timing.

With the continuous bag-making and packaging apparatus according to the present disclosure, an operator can set a print timing on the basis of information pertaining to the print timing; accordingly, there are fewer trial-and-error repetitions and productivity improves.

DETAILED DESCRIPTION

Below is a description, made with reference to the drawings, of an embodiment of the present disclosure. The following embodiment is a specific example of the present disclosure, and is not intended to limit the technical scope of the present disclosure.

(1) Overall Configuration of Continuous Bag-Making and Packaging Apparatus 1

Figure 1:
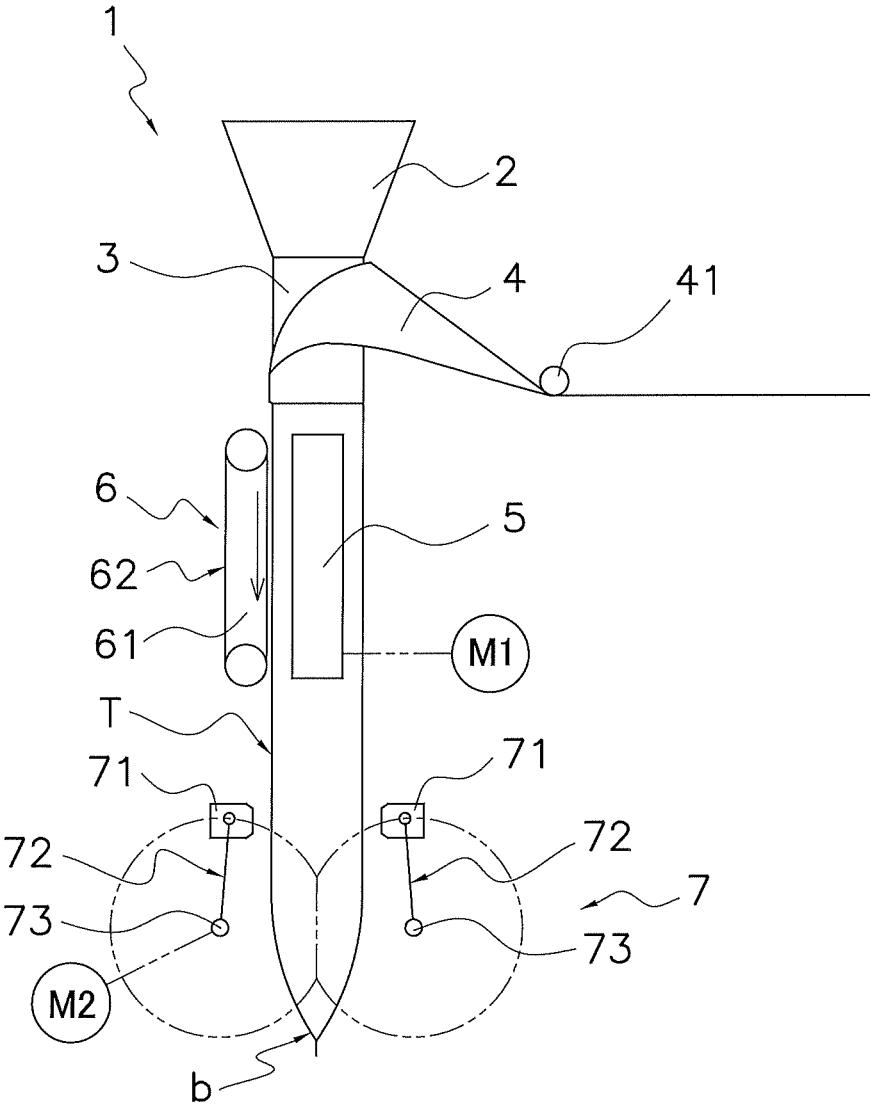
FIG. 1 is an explanatory drawing of a main section of a continuous bag-making and packaging apparatus according to an embodiment of the present disclosure.

FIG. 1 shows an explanatory drawing of a main section of a continuous bag-making and packaging apparatus according to an embodiment of the present disclosure. In FIG. 1, a continuous bag-making and packaging apparatus 1 is provided with a cylinder 3, a former 4, a conveying means 5, a longitudinal sealing device 6, and a transverse sealing device 7. The cylinder 3 is linked to a lower opening part of an upper hopper 2.

The former 4 is wrapped around an outer periphery of the cylinder 3, with a gap opened to allow a belt-form film to pass through. The conveying means 5 is constituted of a left and right pair, and these means downwardly convey a tube-form film T wrapped around the cylinder 3 while suctioning the film.

The longitudinal sealing device 6 heat-fuses together both side edges of the tube-form film T wrapped around the cylinder 3. The transverse sealing device 7 is disposed below the longitudinal sealing device 6. In FIG. 1, a side where the longitudinal sealing device 6 is disposed is a front side, and a direction orthogonal to the plane of the drawing is a left-right direction.

(2) Detailed Configuration (2-1) Cylinder 3 and Former 4

The former 4 causes the belt-form film to pass over a surface of the former 4 from below a guide roll 41, wraps the film around the cylinder 3, and shapes the film into a form of a tube. The cylinder 3 and the former 4 cause both side edges of the tube-form film T to overlap at a front side of the cylinder 3. The longitudinal sealing device 6 applies pressure and heat from above the overlapping portion, whereby a seam of the tube-form film T is longitudinally sealed.

(2-2) Conveying Means 5

In the conveying means 5, a perforated belt moves around a periphery of a negative pressure chamber having an opening part provided on a side that contacts the tube-form film T, whereby the tube-form film T is conveyed downward while being suctioned.

The conveying means 5 are provided facing each other on a left and right side of the tube-form film T, so that the tube-form film T is sandwiched between the two means from left and right.

(2-3) Longitudinal Sealing Device 6

In the longitudinal sealing device 6, a metal belt 62 moves around a heater 61 in the direction of the arrow. The metal belt 62 continuously heat-fuses both side edges of the tube-form film T wrapped around the cylinder 3 while pushing these edges against the cylinder 3, and longitudinally seals the seam of the tube-form film T.

(2-4) Transverse Sealing Device 7

The transverse sealing device 7 performs a horizontal transverse seal in the tube-form film T while causing a pair of front and rear sealing jaws 71 to pressure contact and then move away from each other. The transverse sealing device 7 simultaneously transversely seals an upper opening part of a bag b at a lower end and a lower part of a successive bag continuing from the first bag, and then cuts a border between the bags.

The transverse sealing device 7 has a pair of sealing jaws 71, pivoting arms 72, and a reciprocating motion mechanism 8. The pair of sealing jaws 71 are disposed facing each other in a front-rear direction. The pivoting arms 72 cause the sealing jaws 71 to pivot inward towards each other. The reciprocating motion mechanism 8 (described hereinafter) causes rotating shafts 73 of the pivoting arms 72 to move toward and away from each other.

(2-4-1) Sealing Jaws 71

Figure 2:
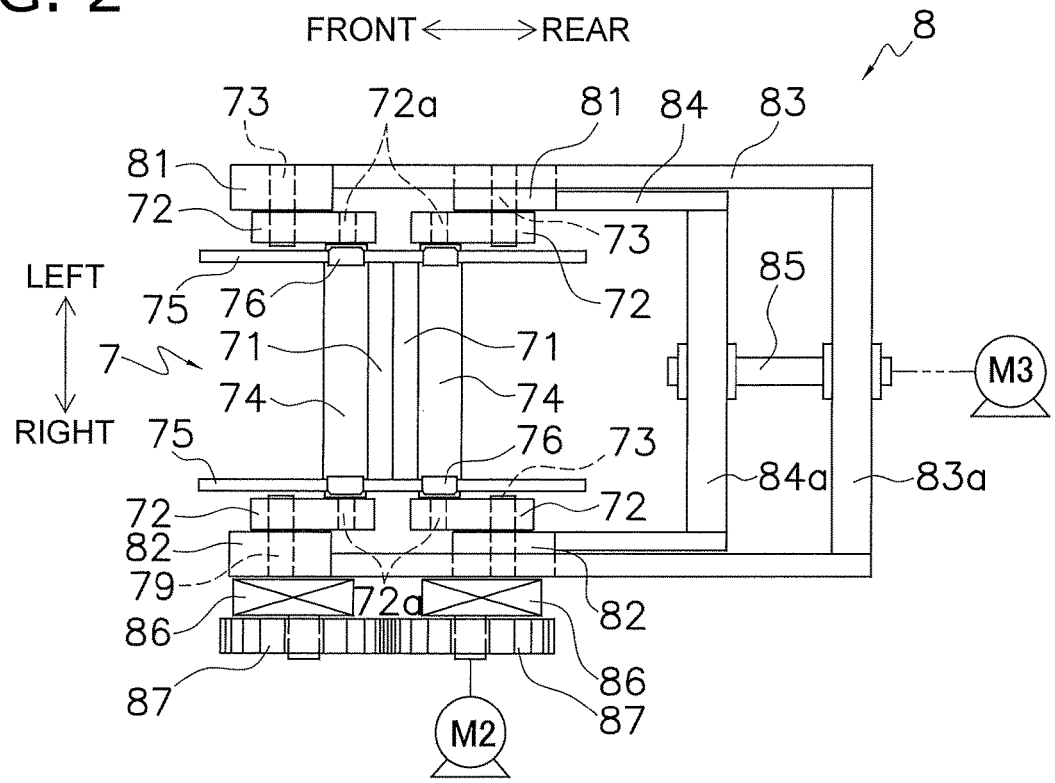
FIG. 2 is a structural schematic drawing of a transverse sealing device.

FIG. 2 shows a plan view of the transverse sealing device 7. In FIG. 2, the pair of front and rear sealing jaws 71 are respectively attached to base members 74. Both ends of the base members 74 are turnably attached via shafts 72*a* to distal end parts of the left and right pivoting arms 72.

(2-4-2) Pivoting Arms 72

The rotating shafts 73 of the left-side pivoting arms 72 are respectively attached to left-side front and rear bearing parts 81. The rotating shafts 73 of the right-side pivoting arms 72 are respectively attached to right-side front and rear bearing parts 82.

Linear bearings 76, through which linking rods 75, 75 are inserted, are respectively attached to upper parts of both ends of the base members 74. The base members 74 and the sealing jaws 71 linked thereto are thereby maintained in a horizontal orientation, even if the pivoting arms 72 pivot inward towards each other about the rotating shafts 73.

(2-4-3) Reciprocating Motion Mechanism 8

The reciprocating motion mechanism 8 has a front-side left bearing part 81, similarly a front-side right bearing part 82, an outer-side frame 83, a rear-side left bearing part 81, a rear-side right bearing part 82, an inner-side frame 84, a turnbuckle 85, and a servomotor M3.

The outer-side frame 83 is a member that is U-shaped in plan view and that links the left and right bearing parts 81. The inner-side frame 84 is a member that is U-shaped in plan view and that links the left and right bearing parts 81, 82.

The turnbuckle 85 is attached between respective linking parts 83*a*, 84*a* of the frames 83, 84, the turnbuckle 85 causing the frames 83, 84 to move toward and away from each other. The servomotor M3 causes the turnbuckle 85 to rotate forward and in reverse.

At the same time as the servomotor M3 causes the turnbuckle 85 to rotate forward and in reverse and causes the frames 83, 84 to move toward and away from each other, the front and rear pair of bearing parts 81, 82 linked to the frames 83, 84, and the front and rear pair of rotating shafts 73 and pivoting arms 72 incorporated therein are caused to move toward and away from each other, and the sealing jaws 71 are caused to move in a D-shaped path.

The front-side left and right bearing parts 81, 82, and the U-shaped outer-side frame 83 linking these bearing parts, are slidably attached to a main frame (not shown), and the rear-side left and right bearing parts 81, 82 are slidably attached to the outer-side frame 83.

Output shafts of Schmidt couplings 86 are linked to the right-side rotating shafts 73 among the four rotating shafts 73, and rotating shafts of a pair of meshing gears 87 are linked to input shafts of these couplings 86. One gear 87 is linked to a servomotor M2, and the two gears 87 are configured to rotate inward towards each other.

The Schmidt couplings 86 are power transmission mechanisms, and constant rotational torque is transmitted to the pivoting arms 72 by the transmission function of these couplings 86 even if the bearing parts 82 move towards and away from each other.

(2-5) Control Means 9

Figure 3:
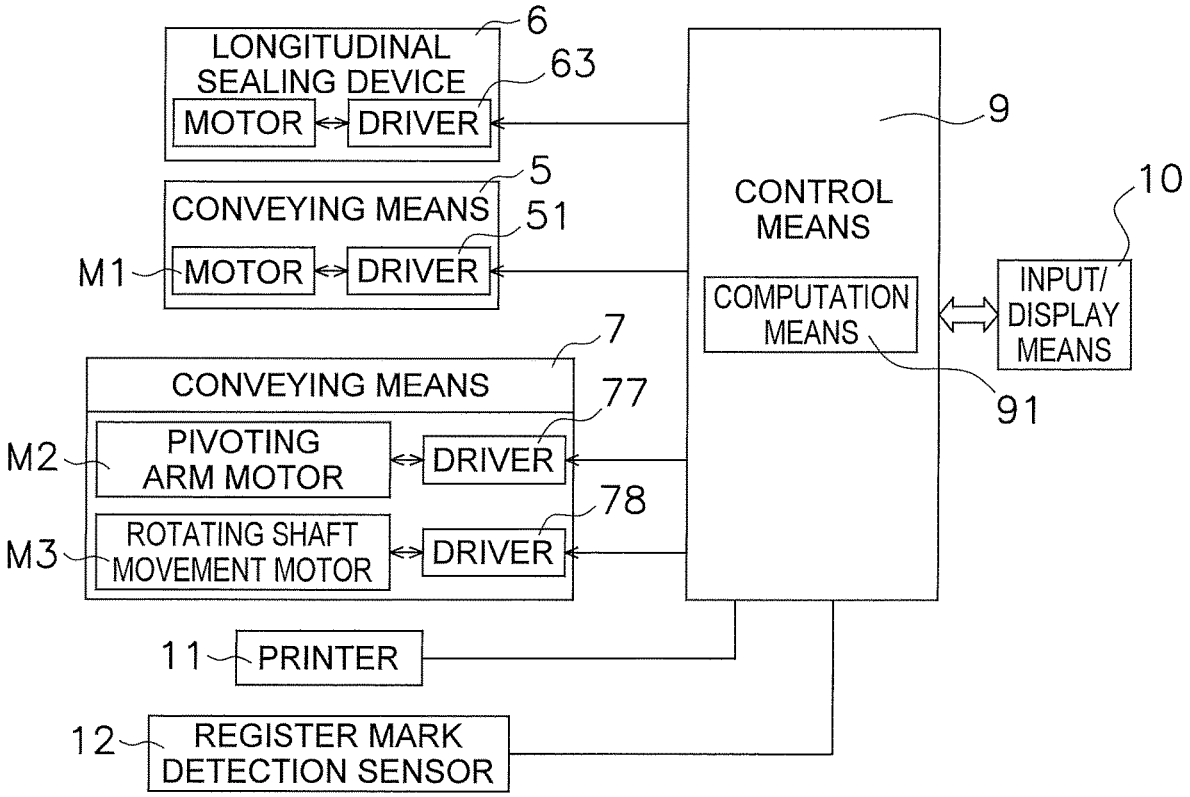
FIG. 3 is a control block diagram of the bag-making and packaging apparatus.
Figure 4:
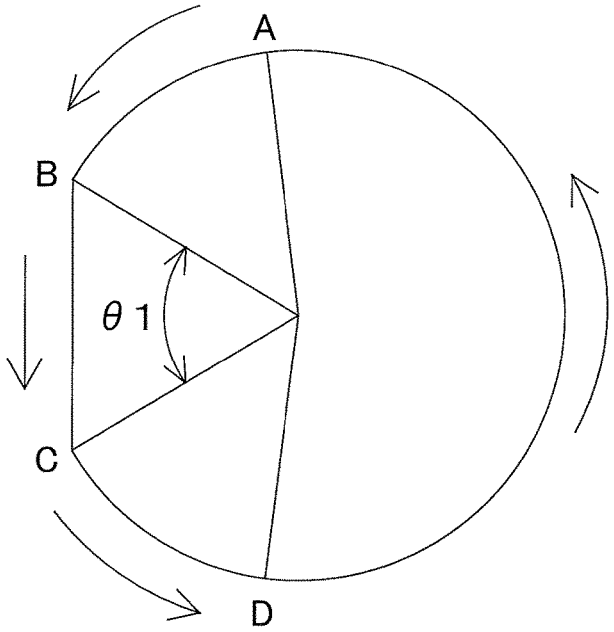
FIG. 4 is an explanatory drawing of a D motion action.
Figure 5:
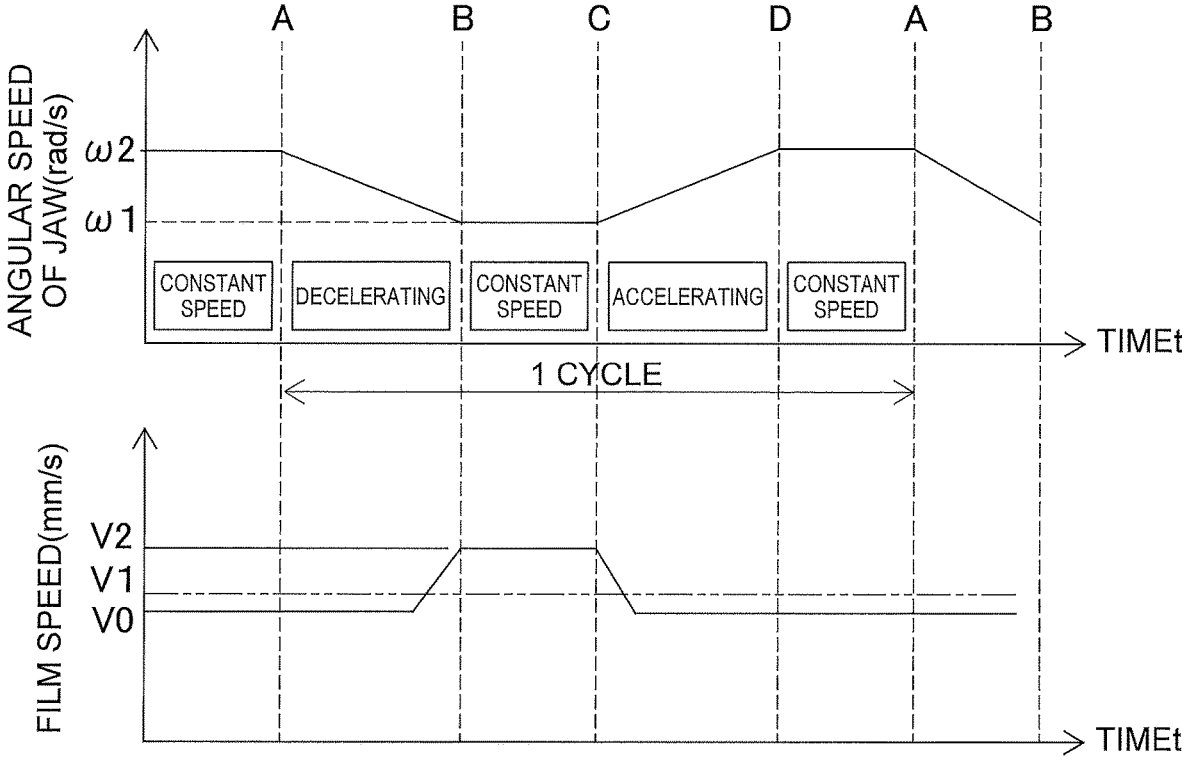
FIG. 5 is a timing chart of a conveying speed of a tube-form film and an angular speed of sealing jaws.

FIG. 3 is a control block diagram of the continuous bag-making and packaging apparatus 1 according to the present embodiment. FIG. 4 is an explanatory drawing of an action of a D motion. FIG. 5 is a timing chart of a conveying speed of the tube-form film and an angular speed of the sealing jaws.

In FIGS. 3, 4, and 5, a control means 9 to control the entire continuous bag-making and packaging apparatus 1 is configured from a microcomputer, and connected thereto are an input/display means 10 configured from a touch panel, the conveying means 5 to convey the tube-form film T, the longitudinal sealing device 6, and the transverse sealing device 7.

When, for example, running speed (bpm; number of bags per minute), bag information such as bag length (mm), and sealing time (msec), etc., are inputted from the input/display means 10, the control means 9 uses a computation unit 91 to calculate the conveying speed of the tube-form film T during sealing, a linear distance of interval B-C, an angular speed ω1, an angular speed of interval A-B, an angular speed of interval C-D, and an angular speed ω2 of interval D-A, while taking into account a mechanical constraint condition of the transverse sealing device 7 and a load characteristic of the servomotor M2, which is a pivoting arm motor.

Specifically, provided that the running speed is determined, a time needed for the pair of sealing jaws 71 to rotate once (one cycle time shown in FIG. 4) is determined, and an average conveying speed V1 (see FIG. 2) of the tube-form film T is determined as well.

Provided that a conveying speed V2 of the tube-form film T during interval B-C is determined, a conveying speed V0 during interval C-B, an acceleration rate when V0 rises to V1, and a deceleration rate when V1 falls to V0 are determined as well, and the computation unit 91 therefore forwards these as control parameters to a driver 51 of the conveying means 5 and a driver 63 of the longitudinal sealing device 6. The parameters are additionally forwarded to the longitudinal sealing device 6 in order to synchronize a conveying speed of the metal belt 62 with a conveying speed of the tube-form film T.

In interval B-C, the sealing jaws 71 fall at a constant speed; accordingly, the computation unit 91 calculates an angular speed of the pivoting arms 72 for each micro unit time when the sealing jaws 71 are lowered a fixed distance, and a horizontal movement distance and speed of the rotating shafts 73, and stores these as control parameters for the servomotor M2, which is a pivoting arm motor, and as control parameters for the servomotor M3, which is a rotating shaft movement motor, during interval B-C.

Furthermore, the computation unit 91 calculates an angular acceleration rate in interval C-D, an angular speed in interval D-A, and an angular deceleration rate in interval A-B, of the pivoting arms 72, and forwards these obtained control parameters and angular speeds to a driver 77 of the servomotor M2, which is a pivoting arm motor. As for control parameters for the servomotor M3, which is a rotating shaft movement motor, these parameters are forwarded to a driver 78 of the servomotor M3, which is a rotating shaft movement motor.

(3) Actions of Continuous Bag-Making and Packaging Apparatus 1

Next, the actions of the continuous bag-making and packaging apparatus 1 according to this embodiment shall be described on the basis of the drawings. An operator operates the input/display means 10 shown in FIG. 3 and sets the continuous bag-making and packaging apparatus 1 to a standby running state.

In this state, the longitudinal sealing device 6 stands by at a position set apart from the tube-form film T, and the heater 61 is heated and maintained at a set temperature.

The conveying means 5 stands by in a state of adhering firmly to a side surface of the tube-form film T, the sealing jaws 71 of the transverse sealing device 7 move to a home position to stand by, and the sealing jaws are heated and maintained at a set temperature.

Then, when the running speed, bag length, sealing time, etc., are inputted from the input/display means 10, the control means 9 calculates the control parameters and/or angular speed using the computation unit 91, and forwards these to the drivers 51, 63, 77, 78 and sets the parameters therein.

When a run key (not shown) displayed on the input/display means 10 is operated, the metal belt 62 of the longitudinal sealing device 6 firmly adheres to the tube-form film T, and a pull-down belt of the conveying means 5 then begins to rotate in synchronization with the metal belt 62.

The sealing jaws 71 that were standing by at the home position then move in the D-shaped movement path, shown in FIG. 4, on the basis of the set control parameters and/or angular speeds while pivoting inward towards each other.

At this time, the conveying means 5 and the metal belt 62 reach the high conveying speed V2 in interval B-C while accelerating in an approach interval immediately before entering interval B-C, and convey the tube-form film T for a set sealing time at the conveying speed V2.

When interval B-C is passed, the speed decreases to a low speed V0, and the speed V0 is maintained once this speed V0 is reached.

Thus, while moving in the D-shaped movement path, the sealing jaws 71 transversely seal the bag b formed at the lower end part of the tube-form film T.

(4) Setting of Print Timing

The print timing is set via the input/display means 10, before the continuous bag-making and packaging apparatus 1 is set into operation. Additionally, the computation unit 91 computes the print timing and presents the print timing via the input/display means 10. Therefore, the computation unit 91 serves as both a print timing computation unit and a print timing presentation unit.

(4-1) Display of Print Timing

Figure 6A:
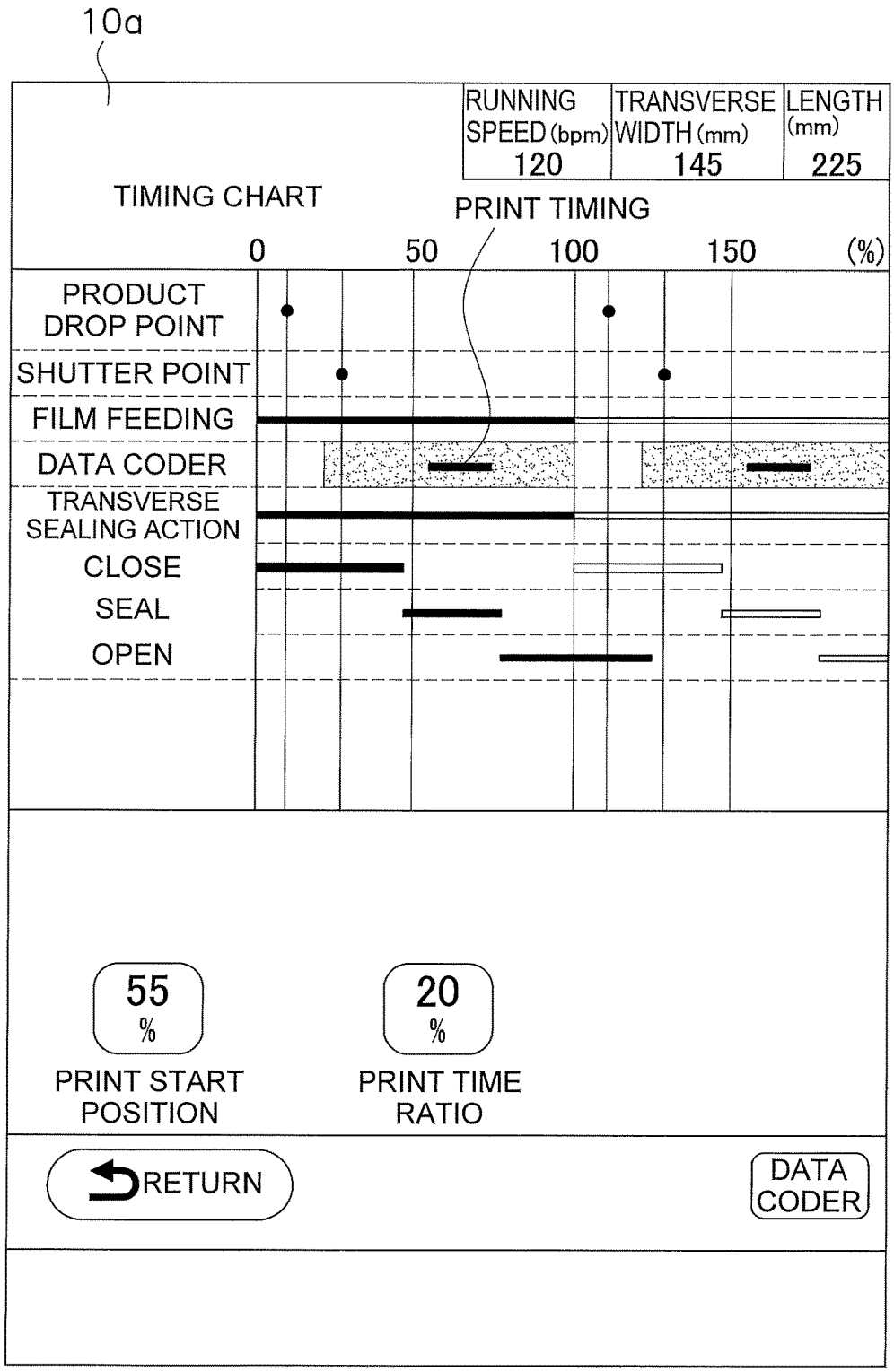
FIG. 6A is a display screen of an input/display means to display a set print timing, displaying that the print timing is appropriate.
Figure 6B:
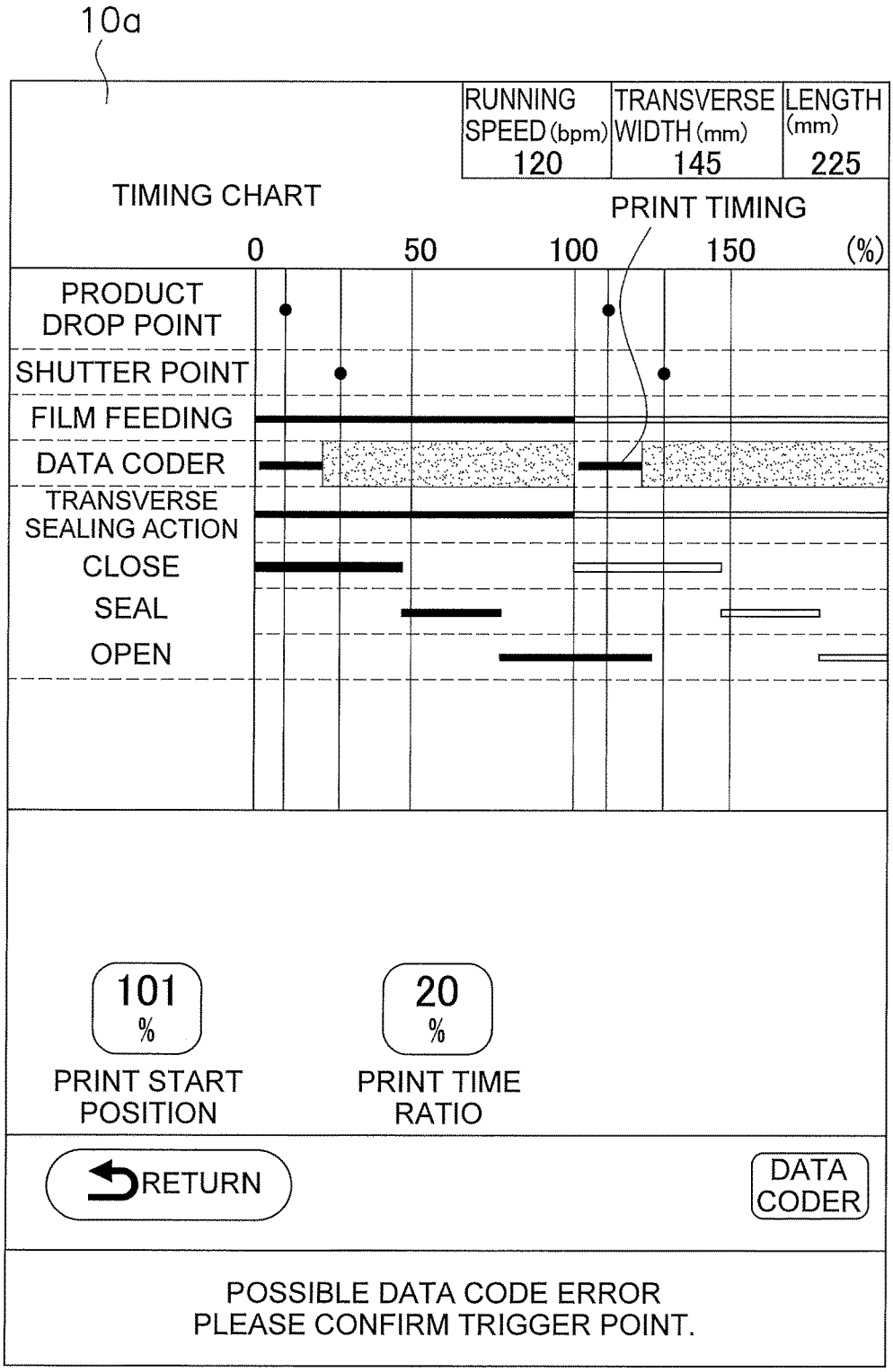
FIG. 6B is a display screen of an input/display means to display a set print timing, displaying that the print timing is inappropriate.

FIGS. 6A and 6B each show a display screen 10*a* of the input/display means 10, which displays a set print timing; FIG. 6A displays an example of print timing being appropriate and FIG. 6B displays an example of print timing being inappropriate.

In FIG. 6A, the three frames in the right corner of a front view of the display screen 10*a*, starting at the left, show running speed, transverse bag width, and bag length.

For the running speed, the number of bags made per minute (units: bpm) is displayed. The transverse bag width (units: mm) is the width dimension in the direction of transverse sealing. The bag length (units: mm) is the length in the conveying direction of the tube-form film T.

A timing chart of the actions is displayed in the middle level of the display screen 10*a*, and timings are represented along the transverse direction in cycle ratios, one cycle being 100%.

The vertical item column shows the names of the actions. Displayed for these actions, in the following order from the top, are "product dropping point," "shutter point," "film feeding," "data coder," and "transverse sealing action."

The "product dropping point" indicates a timepoint at which a product is dropped into the upper hopper 2. The term "shutter point" refers to a timepoint at which a location on the tube-form film T, above a location appointed for transverse sealing, is closed before transverse sealing. The shutter action is performed before transverse sealing so that contents do not become trapped when the sealing jaws 71 transversely seal the tube-form film T.

"Film feeding" indicates a state in which the tube-form film T is being conveyed, but because the present embodiment is an embodiment of a continuous bag-making and packaging apparatus, film feeding takes place throughout the entire cycle.

The "data coder" indicates the range in which the print timing can be set, i.e., an allowable print timing range. A printer 11, which is a printing unit, can cause a head to move and print on the tube-form film T being conveyed, but a recommended value for a film-feeding speed differs depending on the printer 11.

Furthermore, the film-feeding speed differs depending on the running speed, and proper printing therefore cannot be performed when the film-feeding speed has deviated from the recommended value for the printer 11 being used. Therefore, the operator is required to set the print timing in a highlighted area within a frame of a data coder.

(4-1-1) Case of Appropriate Print Timing

When the setting of the print timing is proper, bands indicating the print timing are displayed in the highlighted areas of the data coder, as shown in FIG. 6A. However, when the setting of the print timing is inappropriate, bands indicating the print timing are displayed outside of the highlighted areas of the data coder.

A timing of a transverse sealing action is shown below the data coder. Timings of a closing action, sealing action, and opening action of the sealing jaws 71 are displayed so as to be visible.

In FIG. 6A, it is recognizable that the print timings within the data coder stay within a time range of the transverse sealing action. The speed of the sealing jaws 71 is harmonized with the film-feeding speed in order for the sealing jaws 71 to perform a transverse seal, and the print timing is therefore understood to be a period in the sealing action at which the film-feeding speed is constant.

A print start position and a print time ratio are displayed in a frame further below a display frame of the transverse sealing action in FIG. 6A. The print start position is displayed in a delay time ratio from a starting point of one cycle, with one cycle period being 100%. The print time is displayed in a ratio of printing time to a period of one cycle.

For example, in FIG. 6A, printing begins at a position delayed by 55%, in terms of the cycle ratio, from the starting point of one cycle, and takes place in a period of 20% in terms of the cycle ratio.

(4-1-2) Case of Inappropriate Print Timing

By contrast, bands indicating print timing are displayed outside of the highlighted areas of the data coder in FIG. 6B, where a case of an inappropriate print timing is shown for reference. Regarding the print start position and the print time ratio, printing begins at a position delayed by 101%, in terms of the cycle ratio, from a starting point of one cycle, and takes place in a period of 20% in terms of the cycle ratio.

During this period, the sealing jaws decelerate and film feeding accelerates in order to harmonize the sealing jaw speed and the film-feeding speed during transverse sealing as shown in FIG. 5, and this time period is inappropriate for printing.

In this case, messages "Possible data code error" and "Please confirm trigger point" are displayed in a lowest-level frame of the display screen 10*a*. A method to confirm a trigger point is described below.

(4-2) Setting of Data Code

A "return key" is provided leftward in a second frame from a bottom of the display screen 10*a* in FIGS. 6A and 6B, and a "data coder key" is provided in the right of this frame. The return key is used to return to a previous screen.

The data coder key is a key for switching to a screen where a data code is set. Also, in cases in which the trigger point is changed to change the setting of the print timing, the data coder key is pushed to switch the screen to a screen where the data coder is set.

(4-2-1) Case of Appropriate Trigger Point

Figure 7A:
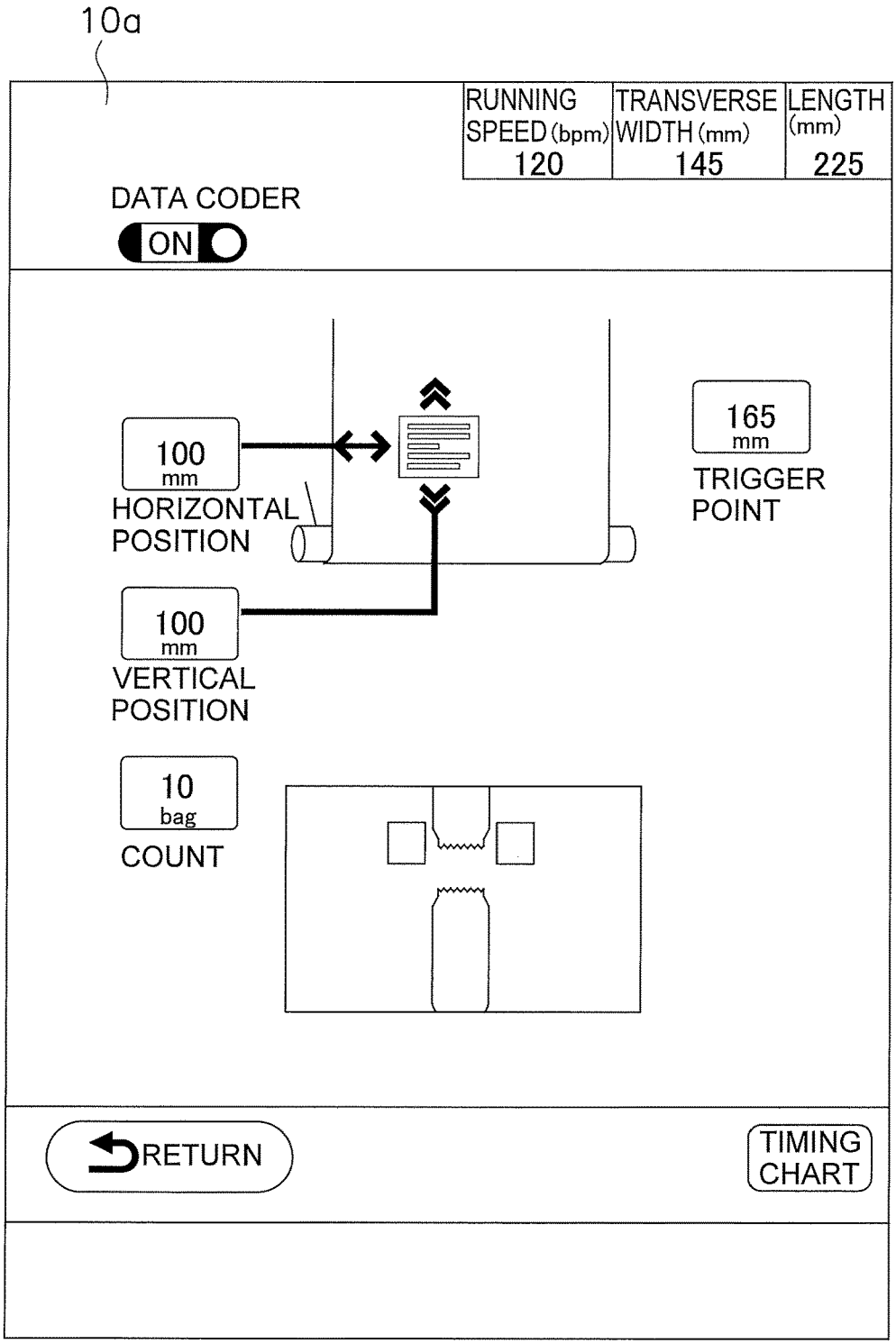
FIG. 7A is a screen where a data code is set, displaying that a trigger point is appropriate.
Figure 7B:
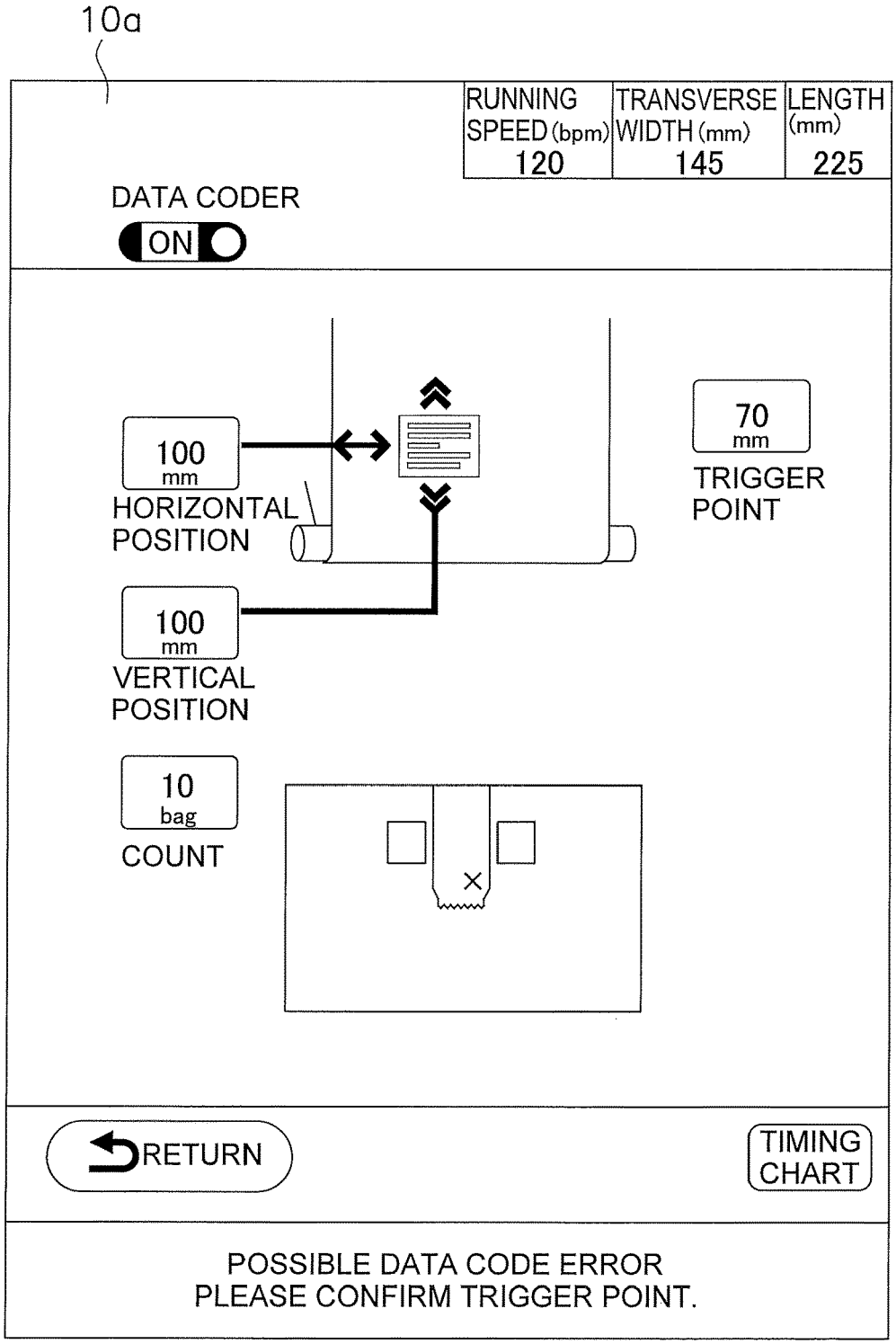
FIG. 7B is a screen where a data code is set, displaying that a trigger point is inappropriate.

FIGS. 7A and 7B show screens where the data code is set FIG. 7A displays a case of an appropriate trigger point, and FIG. 7B displays a case of an inappropriate trigger point. In FIG. 7A, the film is shown in a center, and a "horizontal position" and a "vertical position," represent coordinates of the print position on a left side of a film illustration. The coordinates of the print position are set by horizontal distance from a left end of the film and by vertical distance from a lower end.

Rightward in the film illustration is displayed "trigger point," which indicates a distance from a register mark in the print position. A number written at the trigger point indicates the distance from the register mark.

For example, the trigger point is 165 mm in FIG. 7A, which means that a position 165 mm from the register mark is the print start position. The register mark is marked on the bag in advance, and when the register mark is detected by a register mark detection sensor 12 placed downstream of the former 4 and upstream of the printer 11, printing is started at a position advanced 165 mm therefrom downstream in a film-feeding direction.

(4-2-2) Case of Inappropriate Trigger Point

By contrast, the trigger point is set to 70 mm in FIG. 7B, where a case of an inappropriate trigger point is shown for reference. In this case, the sealing jaws 71 decelerate and film feeding accelerates during this period in order to harmonize the sealing jaw speed and the film-feeding speed during transverse sealing as shown in FIG. 5, and this period is inappropriate for printing.

In this case, the messages "Possible data code error" and "Please confirm trigger point" are displayed in the lowest-level frame of the display screen 10*a*.

The operator changes the trigger point in order to resolve an error. If the trigger point becomes appropriate, the print timing becomes appropriate, and provided that the screen returns to a timing chart display screen, the screen will have print timing bands displayed in the highlighted areas of the data coder, such as is shown in FIG. 6A.

(5) Characteristics (5-1)

With the continuous bag-making and packaging apparatus, the operator can set the print timing on the basis of information pertaining to the print timing; accordingly, there are fewer trial-and-error repetitions, and productivity improves.

(5-2)

The computation unit 91, which functions as the print timing presentation unit, displays the print timing via the display screen 10*a* of the input/display means 10, which displays the timings of the actions of bag-making. Accordingly, the operator can visually observe the print timing from the display screen 10*a*, thus affording ease of use.

(5-3)

The operator can make corrections to whether or not the value inputted from the input/display means 10 is suitable, while visually observing the appropriateness of the set print timing, thus affording ease of use.

(5-4)

The computation unit 91, which functions as the print timing presentation unit, calculates the feeding speed of the film at timepoints in a bag-making cycle from the bag information acquired via the input/display means 10, further calculates an acceleration/deceleration range over which printing is possible from a following capacity of the printer 11, and assesses the appropriate print timing. The print timing, which is assessed on the basis of both the film-feeding speed and the following capacity of the printer, is highly reliable.

(5-5)

The computation unit 91, which functions as the print timing presentation unit, calculates the feeding speed of the film using bag-making capacity, bag length, and transverse sealing time as parameters; therefore, a highly accurate feeding speed can be calculated.

(5-6)

The computation unit 91, which functions as the print timing presentation unit, determines the acceleration/deceleration range over which printing is possible in accordance with the printer 11 selected via the display screen 10*a* of the input/display means 10, which is also a printer selection screen. Therefore, the operator is saved the trouble of determining the acceleration/deceleration range, thus affording ease of use.

(5-7)

A register mark detection sensor 12 to detect a register mark marked on the bag is further provided, and a distance from the register mark is included as print position data in the bag information. Therefore, the distance from the register mark is a factor in determining the print timing, and a reference can be assigned. Accordingly, the print position can be set while being imaged.

The "distance from the register mark" is the distance the tube-form film T is conveyed after the register mark detection sensor 12 detects the register mark.

Additionally, the phrase "the print position can be set while being imaged" means that the print position can be adjusted without taking care of the print timing, while observing an image displayed on the display screen 10*a* as a screen where a data code is set (the print timing can be changed by changing the trigger point displayed on the display screen 10*a*).

Furthermore, to "adjust the print position" is to adjust a vertical position of the print location by automatically or manually moving a reel-in roller (not shown; a roller positioned upstream of the former 4), and the adjustment result can be confirmed by the "vertical position" displayed on the display screen 10*a* as a screen where a data code is set.

(6) Other Configurations

The embodiment described above was premised on transverse sealing being performed while the sealing jaws 71 move in a D motion. However, this embodiment is not provided by way of limitation; transverse sealing can involve rotary sealing performed by rotary arc jaws, or transverse sealing can be performed while the sealing jaws move in a box motion.

REFERENCE SIGNS LIST

1 Continuous bag-making and packaging apparatus
5 Conveying means (film-conveying unit)
10 Input/display means (bag information acquisition unit)
10*a* Display screen (input screen, selection screen)
11 Printer (printing unit)
12 Register mark detection sensor
91 Computation unit (print timing presentation unit)
T Tube-form film (film)

What is claimed is:

1. A continuous bag-making and packaging apparatus in which sealing is performed on a film at a predetermined position to make a bag while the film is continuously conveyed, the continuous bag-making and packaging apparatus comprising:

a film-conveying unit configured to change a feeding speed of the film during one cycle of making the bag;

a printing unit configured to print on the film conveyed;

a bag information acquisition unit configured to acquire information of a bag to be made;

a display unit configured to display a timing of an action of the bag-making;

a print timing presentation unit configured to calculate the feeding speed of the film at timepoints in the cycle of making the bag from the information of the bag and to present a print timing suitable for printing and the timing of the action of the bag-making at the same time with a diagram to the display unit based on the information of the bag; and a control unit configured to cause presenting the print timing suitable for printing to the display unit with the diagram via the print timing presentation unit within a period at which the feeding speed of the film is constant.

2. The continuous bag-making and packaging apparatus according to claim 1, wherein the print timing presentation unit displays the print timing through a display screen of the display unit that displays the timing of the action of the bag-making.

3. The continuous bag-making and packaging apparatus according to claim 1, wherein the print timing presentation unit displays, on an input screen of the display unit in which the print timing is inputted, whether or not a value inputted through the input screen is appropriate.

4. The continuous bag-making and packaging apparatus according to claim 3, further comprising a register mark detection sensor configured to detect a register mark marked on the bag, wherein a distance from the register mark is included as print position data in the information of the bag.

5. The continuous bag-making and packaging apparatus according to claim 1, wherein the print timing presentation unit calculates an acceleration/deceleration range over which printing is possible from a following capacity of the printing unit, and assesses an appropriate print timing.

6. The continuous bag-making and packaging apparatus according to claim 1, wherein the print timing presentation unit calculates the feeding speed of the film using a bag-making capacity, a bag length, and a transverse sealing time as parameters.

7. The continuous bag-making and packaging apparatus according to claim 1, wherein the print timing presentation unit has a selection screen configured to select a printer to be used in the printing unit, and an acceleration/deceleration range over which printing is possible is determined in accordance with the printer selected in the selection screen.

8. The continuous bag-making and packaging apparatus according to claim 1, wherein the print timing presentation unit is a computation unit configured to compute the print timing.

9. The continuous bag-making and packaging apparatus according to claim 1, further comprising a transverse sealing device including a pair of sealing jaws, pivot arms, and a reciprocating motion mechanism.

* * * * *